United States Patent [19]

Przytulla

[11] Patent Number: 4,925,049

[45] Date of Patent: May 15, 1990

[54] BLOW-MOLDED THERMOPLASTIC DRUM HAVING IMPROVED INTEGRAL BEARING AND TRANSPORT RINGS

[75] Inventor: Dietmar Przytulla, Kerpen, Fed. Rep. of Germany

[73] Assignee: Mauser-Werke GmbH, Bruhl, Fed. Rep. of Germany

[21] Appl. No.: 159,625

[22] Filed: Feb. 23, 1988

[30] Foreign Application Priority Data

Mar. 16, 1987 [DE] Fed. Rep. of Germany ..... 3708432

[51] Int. Cl.[5] ..... B65D 7/44

[52] U.S. Cl. ..... 220/72; 220/5 R

[58] Field of Search ..... 220/72, 5 R, 74, 70, 220/83, 73, DIG. 1, 465, 66

[56] References Cited

U.S. PATENT DOCUMENTS

| | | | |
|---|---|---|---|
| 2,673,010 | 10/1954 | Barrow . | |
| 3,840,141 | 10/1974 | Allom | 220/5 R |
| 3,934,747 | 1/1976 | Needt | 220/72 X |
| 3,955,705 | 5/1976 | Dubois | 220/73 X |
| 4,169,537 | 4/1979 | Sabreen . | |
| 4,228,911 | 10/1980 | Hammes | 220/72 X |
| 4,257,527 | 3/1981 | Snyder | 220/5 R X |
| 4,264,016 | 7/1981 | Speas . | |
| 4,294,374 | 8/1981 | Ames . | |
| 4,643,323 | 2/1987 | Schütz | 220/5 R X |
| 4,674,648 | 6/1987 | Przytulla | 220/72 |
| 4,736,862 | 4/1988 | Hammes | 220/5 R X |

*Primary Examiner*—Harvey C. Hornsby
*Assistant Examiner*—K. O'Leary
*Attorney, Agent, or Firm*—Pennie & Edmonds

[57] ABSTRACT

A blow-molded thermoplastic drum comprising a carrying and transport ring having horizontal and vertical surfaces formed integrally with the drum shell is disclosed. The end portion of the drum shell opposite the carrying and transport ring is set back in conical fashion. To allow handling with standard mechanized drum handling equipment, a wide channel is formed between the vertical contact surface of the ring and the conical section. To this end, the carrying and transport ring is connected to the conical section of the shell by a wide connecting web which forms the bottom of the channel. The web is supported by a support structure. In a first embodiment, the support structure is zig-zag. In a second embodiment, the support structure comprises radially extending projections. Passageways are located in the bottom of the channel to allow runoff of water.

6 Claims, 3 Drawing Sheets

BLOW-MOLDED THERMOPLASTIC DRUM HAVING IMPROVED INTEGRAL BEARING AND TRANSPORT RINGS

BACKGROUND OF THE INVENTION

Presently available container drums are typically made of thermoplastic synthetic material, comprising at least one carrying and transport ring formed on the outer surface of the drum a short distance below the associated end surface of the drum. The ring comprises horizontal and vertical contact surfaces, that is, a first surface extending radially outwardly and a second surface extending parallel to the axis of the drum, for interfitting with the lift arms of conventional mechanized drum handling equipment. The drum may be produced entirely by the blow molding process, and the carrying and transport ring may be formed integrally with the shell and ends of the drum.

When lifting and transporting a drum, the arms of conventional mechanized drum handling equipment engage below the horizontal contact surface and behind the vertical contact surface of the carrying and transport ring. The total weight of the drum is transmitted to the lower lift arm via the horizontal contact surface, while the engagement of the upper lift arm behind the vertical contact surface prevents the drum from slipping off the lower arm.

The shell and ends of such drums may be produced integrally with the bearing and transport ring, e.g., by blow-molding. See U.S. Pat. Nos. 4,228,122 and 4,674,648. Alternatively, the bodies of such drums may be produced by the blow-molding process, while the end members and rings are produced by the injection-molding process. The injection-molded end members, with the bearing and transport rings formed thereon, are welded onto the body of the drum in a separate operation.

Because control of the welding step is difficult in this design, the carrying and transport rings are typically designed so that the critical weld zone created during the molding and forming process is largely relieved of bending forces. For this purpose, the carrying and transport ring is joined to the drum by way of a connecting web meeting the surface of the drum and joining the horizontal contact surface. The connecting web is designed so that it is stressed only by harmless tensile loads when the drum is lifted and transported by the ring.

To make the attachment as elastic as possible, the carrying and transport ring has been designed to meet the surface of the drum at an acute angle to the axis of the drum. An example of this design is shown in U.S. Pat, No. 4,674,648. In this design, the channel formed between the axially extending vertical surface of the carrying and transport ring and the adjacent conical surface section of the drum is essentially V-shaped in cross-section. The channel bottom is located in the plane of the horizontal contact surface of the carrying and transport ring. Hence, the space between the vertical contact surface and the conical surface section of the drum is very narrow, especially since the stacking forces which are produced upon stacking filled drums must be diverted by way of the conical surface into the cylindrical center section of the drum. The narrow groove requires that the ends of the upper arm of the drum handling equipment used have a special shape.

SUMMARY OF THE INVENTION

Accordingly, it is an object of the present invention to provide a container drum of thermoplastic synthetic material which may be formed entirely in one piece by the blow-molding process, including an integral carrying and transport ring, and which is capable of being transported without difficulty by standard mechanized drum handling equipment, including equipment used for moving metal drums.

Another object of the invention is to provide a drum having a carrying and transport ring, as above, in which the outer diameter of the ring remains unaltered as compared to prior art constructions thereby allowing palletizing of the drum.

Another object of the invention is to provide an improved means of attachment for a carrying and transport ring to a drum such that detrimental bending forces on the ring are more efficiently distributed.

According to the invention, at least one carrying and transport ring is formed integrally with the drum shell, near one end thereof, and in particular adjacent the conical section of the drum shell. This conical section is inclined toward the center of the drum and is set back somewhat with respect to the rest of the drum shell. The carrying and transport ring is connected to this conical section by a wide connecting web. This measure provides enough room for insertion of the upper lift arm of conventional drum handling equipment behind the vertical contact surface of the carrying and transport ring. In addition, the outer diameter of the carrying and transport ring remains unaltered when compared to prior constructions such that the drum is readily palletizable.

A support band structure is provided beneath the connecting web for joining the connecting web to the surface of the drum below the level of the horizontal contact surface of the carrying and transport ring. This permits absorption of the increased bending forces acting on the connecting web owing to the weight of stacked drums and at the same time safely supports the carrying and transport ring. The support band structure consists of an array of projections extending outwardly from the conical section of the drum shell to support the carrying and transport ring from below the connecting web to the vicinity of its joinder to the vertical contact surface of the ring. In a first embodiment, each pair of projections extend outwardly at angles to each other and are joined at their outer edges to form a band of zig-zag shape. In a second embodiment, each of the band support projections extend radially outwardly.

DETAILED DESCRIPTION OF PREFERRED EMBODIMENTS

Figure 2:
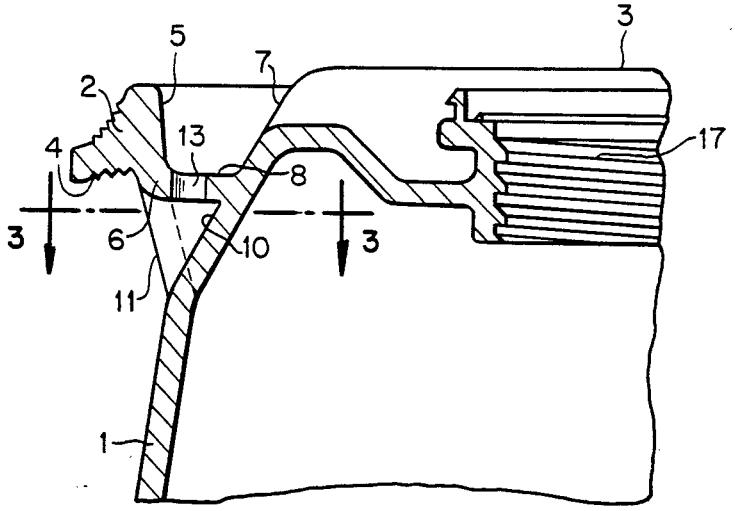
FIG. 2 shows a cross-sectional view of the upper left portion of the drum of FIG. 1, corresponding to a view along section line 2—2 of FIG. 3.
Figure 1:
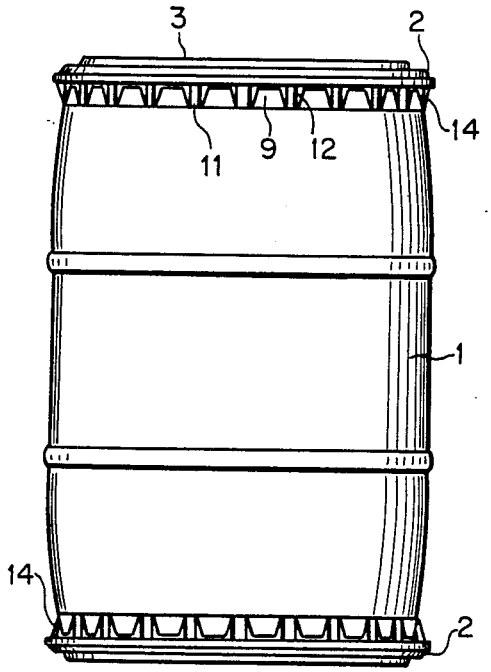
FIG. 1 shows a first embodiment of the drum of the invention in side elevation.
Figure 3:
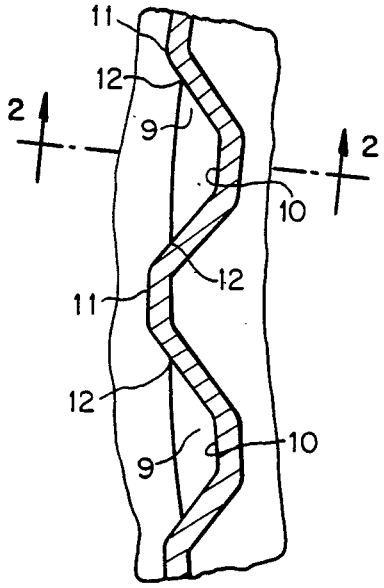
FIG. 3 shows a sectional view along section line 3—3 of FIG. 2.
Figure 4:
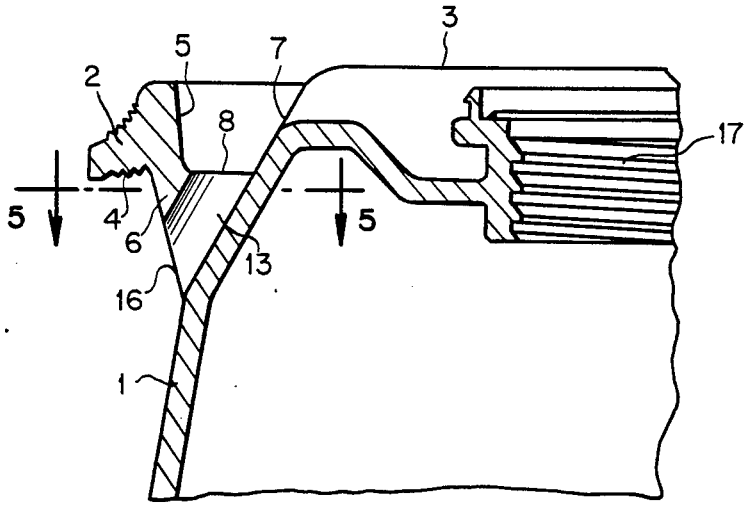
FIG. 4 shows a cross-sectional view corresponding to FIG. 2 of a second embodiment of the drum, corresponding to a view along section line 4—4 of FIG. 5.
Figure 5:
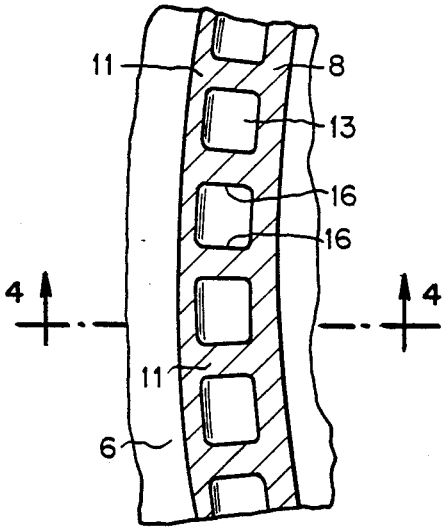
FIG. 5 shows the view along section line 5—5 of FIG. 4.
Figure 6:
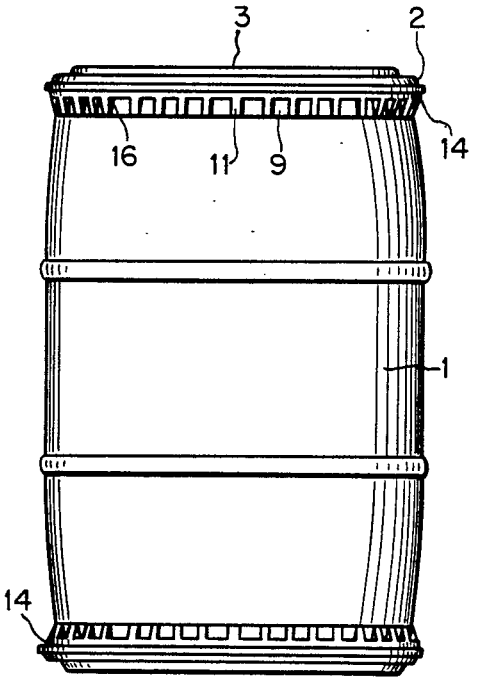
FIG. 6 is an elevational view of the drum in its second embodiment.

FIGS. 1–3 show a first embodiment of the blow-molded thermoplastic drum of the present invention, and FIGS. 4-6 show a second embodiment thereof. In both embodiments, two carrying and transport rings 2 are formed integrally with the drum shell 1, one at each end of the drum. Also integrally formed with the drum shell 1 are support band structures 14, supporting the carrying and transport rings 2. In the end face 3 of the drum, filling and drain connections 3' are arranged in recesses 3" (see FIGS. 2 and 4). Each carrying and transport ring 2 lies a short distance below the associated end face 3 of the drum. Each ring 2 comprises a horizontal contact surface 4 extending generally radially outwardly of the drum and a vertical contact surface 5 extending generally axially. The carrying and transport ring receives the lift arm of conventional mechanized drum handling equipment (not shown).

Each carrying and transport ring 2, as shown in FIGS. 2 and 4, is connected to the surface of the drum by a connecting web 6 which meets the carrying and transport ring 2 at the horizontal contact surface 4. The conical section 7 of the shell of the drum (in both embodiments of the invention) is set back at an inclined angle with respect to the rest of the drum shell and in particular with respect to the central section of the drum which is generally cylindrical. The connecting web 6 joins the surface of the shell at a location along the conical section which is well set back from the cylindrical section of the drum so as to provide a wide channel 8. This joining, as shown in FIGS. 2 and 4, is made at about mid-height along the conical section 7 to produce the wide channel 8.

In the embodiment of FIGS. 1–3 and 7, support band structure 14 supporting the carrying and transport ring 2 includes a plurality of projections defining a zig-zag band extending about and beneath the channel 8. The projections define radially inwardly extending recesses 9 therebetween. The bottom 10 of each recess extends to near the conical section 7 of the drum while the front of each recess is separated from the next recess by a generally vertically extending rib 11. The ribs 11 are connected to the bottom of the recesses by side walls 12. Holes 13 are formed in the connecting web 6 above the recesses 9 to allow drainage of water from channel 8. It will be appreciated by those of skill in the art that the support ribs, the connecting web and the shell of the drum together form a generally triangulated support structure for the carriage and transport ring. The ring thus is spaced well away from the shell, but reliably supports the shell. This allows the drum to be handled conveniently by conventional drum handling equipment of the type also used to handle steel drums. Moreover, thus spacing the ring from the shell prevents rough handling of the ring from damaging the integrity of the shell.

Figure 7:
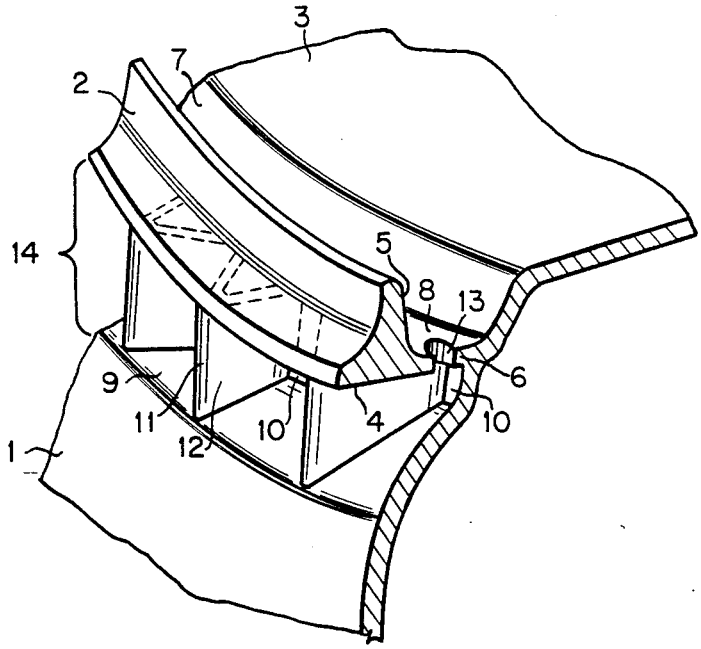
FIG. 7 is a perspective view, in cross-section, of the upper left hand portion of the drum of FIG. 1.
Figure 8:
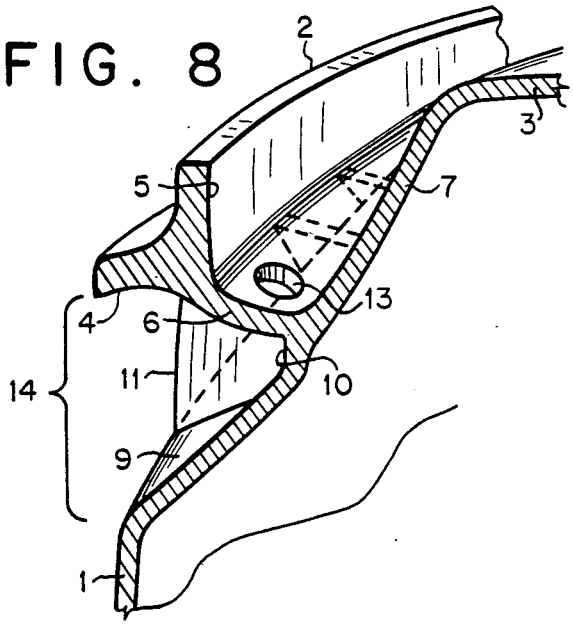
FIG. 8 is a perspective view, in cross-section, of the upper left hand portion of the drum of FIG. 6.

As shown most clearly in FIGS. 3 and 7, each adjacent pair of side walls 12 of the recesses extends at an angle toward each other and the walls are connected together at the front of the recess by the associated rib 11. This provides the zig-zag pattern of support. Also, as seen from FIG. 2, each rib 11 at its top joins the carrying and transport ring 2 at the radially outer end of the connecting web 6. At its bottom, each rib merges with the cylindrical section of the drum.

In the embodiment of FIGS. 4–6 and 8, the support band structure 14 includes projections 16 extending radially outwardly from the wall of the drum 1. Holes 13 are formed in the circular bottom of channel 8, between the projections 16, allowing runoff of water which would otherwise accumulate in the channel 8. As shown in FIG. 4, each projection 16 at its top joins with the under side of connecting web 6 while at its bottom, the projection merges with the cylindrical section of the drum.

What is claimed:

1. In a blow-molded thermoplastic drum comprising a drum shell, having a generally cylindrical center section, conical end sections having predetermined heights and end faces at either end of the drum, and at least one carrying and transport ring formed integrally with said shell and extending around the drum a short distance from an associated end face of the drum, said ring having horizontal and vertical support surfaces meeting at a joinder for engagement by lifting prongs of mechanized drum handling equipment, the improvement comprising:

(a) a connecting web joining the carrying and transport ring to the shell along the conical section of the drum, said connecting web extending generally horizontally outwardly from the conical section of the drum to the joinder of the horizontal and vertical support surfaces of the ring, spacing the ring from the conical section of the drum and forming a wide bottomed groove between the vertical surface of the ring and said conical section of the drum, wherein the connecting web joins said conical section at an intermediate location along the height thereof and (b) a carrying and transport ring support band disposed below the connecting web of the ring and supporting the connecting web on the conical section of the drum.

2. The drum of claim 1 wherein:

(a) the support band comprises a number of projections extending outwardly from the conical section of the drum, said projections being spaced circumferentially about the drum to define recesses therebetween.

3. The drum according to claim 2 wherein:

(a) the projections extend radially outwardly from said conical section.

4. The drum according to claim 3 wherein:

(a) the radial outer ends of the projections, at the upper ends thereof, join with the connecting web at its radial outer end, and at their lower ends merge with the cylindrical section of the drum.

5. The drum according to claim 2 wherein:

(a) said projections extend outwardly of the said conical section in a zig-zag pattern about the circumference thereof.

6. In a blow-molded thermoplastic drum comprising a drum shell, having a generally cylindrical center section, conical end sections having predetermined heights and end faces at either end of the drum, and at least one carrying and transport ring formed integrally with said shell and extending around the drum a short distance from an associated end face of the drum, said ring having horizontal and vertical support surfaces meeting at a joinder for engagement by lifting prongs of mechanized drum handling equipment, the improvement comprising:

(a) a connecting web joining the carrying and transport ring to the shell along the conical section of the drum, said connecting web extending generally horizontally outwardly from the conical section of the drum to the joinder of the horizontal and vertical support surfaces of the ring, spacing the ring from the conical section of the drum and forming a wide bottomed groove between the vertical surface of the ring and said conical section of the drum and (b) a support web, extending outwardly, from a point on the conical section of the drum spaced away from the point at which the connecting web joins the conical section of the drum, to the joinder of the connecting web and the carrying and transporting ring, whereby the connecting web, the shell of the drum, and the support web form a triangulated support structure for the carrying and transport ring.

* * * * *